US008581947B2

(12) United States Patent
Matsuda

(10) Patent No.: US 8,581,947 B2
(45) Date of Patent: Nov. 12, 2013

(54) PRINTER, PRINTING SYSTEM AND COMPUTER-READABLE MEDUIM HAVING INSTRUCTIONS FOR PRINTING

(75) Inventor: Koichi Matsuda, Minato-ku (JP)

(73) Assignee: Sinfonia Technology Co., Ltd., Tokyo (JP)

( * ) Notice: Subject to any disclaimer, the term of this patent is extended or adjusted under 35 U.S.C. 154(b) by 59 days.

(21) Appl. No.: 13/434,051

(22) Filed: Mar. 29, 2012

(65) Prior Publication Data

US 2012/0249714 A1 Oct. 4, 2012

(30) Foreign Application Priority Data

Mar. 31, 2011 (JP) ..... 2011-079967
Mar. 26, 2012 (JP) ..... 2012-068932

(51) Int. Cl.
*B41J 2/00* (2006.01)

(52) U.S. Cl.
USPC ..... 347/190

(58) Field of Classification Search
USPC ..... 347/171, 190, 211, 215, 218
See application file for complete search history.

(56) References Cited

U.S. PATENT DOCUMENTS 5,784,092 A * 7/1998 Fukuoka ..... 347/190
5,896,160 A 4/1999 Katsuma et al.
6,108,019 A 8/2000 Katsuma et al.
6,133,930 A 10/2000 Shibuki et al.
6,661,443 B2 * 12/2003 Bybell et al. ..... 347/190
7,027,076 B2 * 4/2006 Ruiz et al. ..... 347/190
2009/0035493 A1 2/2009 Murakami et al.

FOREIGN PATENT DOCUMENTS

EP 2 020 296 A2 2/2009
JP 11-198425 7/1999
JP 2000-015886 1/2000

OTHER PUBLICATIONS

Extended European Search Report issued Jul. 20, 2012 in Patent Application No. 12162329.2.

* cited by examiner

*Primary Examiner* — Kristal Feggins
(74) *Attorney, Agent, or Firm* — Oblon, Spivak, McClelland Maier & Neustadt, L.L.P.

(57) ABSTRACT

A printer having a ribbon heated by energization of a thermal head to transfer color ink and transparent laminate material from the ribbon to a recording medium. The printer includes a first storage section configured to store ink energization data, a second storage section configured to store laminate energization data an energization controlling section, and a correction section that corrects the laminate energization data in response to a residual heat quantity of the thermal head after the ink is thermally transferred in accordance with stored ink energization data and corrects the laminate energization data.

9 Claims, 5 Drawing Sheets

PRINTER, PRINTING SYSTEM AND COMPUTER-READABLE MEDUIM HAVING INSTRUCTIONS FOR PRINTING

CROSS REFERENCE TO RELATED APPLICATION

This application claims priority to Japanese Application Numbers 2011-079967, filed on Mar. 31, 2011, and 2012-068932, filed on Mar. 26, 2012, the entire contents of which are hereby incorporated by reference.

BACKGROUND OF THE INVENTION

1. Field of the Invention

This invention relates to a printer, a printing system and a computer program for heating a ribbon by energization of a thermal head to thermally transfer a thermal transfer object of the ribbon such as color ink and transparent laminate material to a recording medium such as paper.

2. Description of the Related Art

An exemplary printer of the thermal transfer type is disclosed in Japanese Patent laid-Open No. 2000-15886. In the printer, a ribbon to which a transfer object including a plurality of inks or dyestuffs of different colors is applied is transported together with a recording medium such as paper in a state in which the ribbon is pressed against the recording medium by a thermal head. In this state, the ribbon is heated by energization of a heat generating resistive element of the thermal head to thermally transfer the transfer object of the ribbon to the recording medium. The printer utilizes the fact that, as the heat quantity of the thermal head increases, the transfer amount of the transfer object to the recording medium increases and as the heat quantity of the thermal head decreases, the transfer amount of the transfer object to the recording medium decreases, to control the energization of the heat generating resistive element of the thermal head so that a quantity of heat by which a desired printing result is obtained is generated.

SUMMARY OF THE INVENTION

In the printer described above, if the transfer amount of the laminate material increases, gloss is provided to a printing result, but if the transfer amount of the laminate material decreases conversely, then a matted state in which a printing result is free from gloss is obtained. Therefore, also the energization control of the laminate material upon thermal transfer is significant in determination of the print quality similarly as upon thermal transfer of the ink.

However, in the printer described above, thermal transfer of the transparent laminate material is carried out after color inks of, for example, yellow, magenta and cyan or the like are thermally transferred. Therefore, the residual heat of the thermal head after the color inks are thermally transferred has an influence on the thermal transfer of the laminate material. In other words, even if the thermal head, that is, the heat generating resistive element, is energized in accordance with energization data or pulse data for thermally transferring the laminate material, a desired amount of the laminate material may not be transferred, resulting in degradation of the print quality. For example, in a state in which unnecessary heat remains in the thermal head, the transfer amount of the laminate material increases, and the printing result exhibits a glossy state. On the contrary, if the thermal head is in a fully cooled state, the laminate material may not be thermally transferred sufficiently, and the printing result exhibits a matted state free from gloss.

It is an object of the present invention to provide a printer, a printing system and a computer program which decrease or eliminate an influence of heat remaining in a thermal head as a result of thermal transfer of ink carried out earlier thereby to improve the print quality of laminate material.

According to an embodiment of the present invention, there is provided a printer wherein a ribbon is heated by energization of a thermal head to transfer color ink and transparent laminate material from the ribbon to a recording medium, including a first storage section configured to store ink energization data for thermally transferring the ink, a second storage section configured to store laminate energization data for thermally transferring the laminate material, an energization controlling section configured to energize the thermal head in accordance with the energization data, and a correction section configured to acquire correction data for correcting the laminate energization data in response to a residual heat quantity of the thermal head after the ink is thermally transferred in accordance with the ink energization data stored in the first storage section and correct the laminate energization data from the second storage section to the energization controlling section using the correction data.

With the printer having the configuration described, the ink energization data for thermally transferring the ink and the laminate energization data for thermally transferring the laminate material are stored in the first and second storage sections, respectively, and the energization controlling section carries out energization of the thermal head in accordance with the energization data and so that the inks and the laminate material are thermally transferred to the recording medium. In this instance, although the thermal transfer of the laminate material is influenced by the residual heat quantity of the thermal head after the ink is thermally transferred, since the correction section acquires the correction data for correcting the laminate energization data in response to the residual heat quantity and corrects the laminate energization data using the acquired correction data, the laminate material can be thermally transferred with the laminate energization data corrected with the residual heat quantity of the thermal head after the thermal transfer of ink taken into consideration. Consequently, the print quality can be improved.

In order to eliminate the necessity to incorporate a high speed arithmetic operation unit such as a DSP (Digital Signal Processor) thereby to reduce the cost of the printer, preferably the printer further includes a third storage section configured to store the correction data, the correction section acquiring the correction data from the third storage section and synthesizing the acquired correction data and the laminate energization data to correct the laminate energization data.

As an another form of the printer for improving the print quality, the printer may further include an acceptance section configured to accept image data to be used as a printing object, an ink energization data production section configured to produce the ink energization data based on the image data accepted by the acceptance section and store the produced data into the first storage section, a laminate energization data acquisition section configured to produce or acquire the laminate energization data and store the produced or acquired data into the second storage section, and a correction data production section configured to estimate a residual heat quantity of the thermal head after the ink is thermally transferred in accordance with the image data or the produced ink energization data and produce correction data for correcting the laminate energization data in accordance with the estimated residual heat quantity.

A printing system may be constructed such that the functions implemented by the printer may be exhibited by the entire system. In particular, according to another embodiment of the present invention, there is provided a printing system including a printer wherein a ribbon is heated by energization of a thermal head to thermally transfer color ink and transparent laminate material from the ribbon to a recording medium, and a computer configured for communication with the printer for issuing a thermal transfer instruction to the printer. The computer includes an acceptance section configured to accept image data to be used as a printing object, an ink energization data production section configured to produce ink energization data for thermally transferring ink in accordance with the image data accepted by the acceptance section, a laminate energization data acquisition section configured to produce or acquire laminate energization data for thermally transferring the laminate material, a correction data production section configured to estimate a residual heat quantity of the thermal head after ink is transferred in accordance with the image data or the produced ink energization data and produce the correction data for correcting the laminate energization data in accordance with the estimated residual heat quantity, and an instruction section configured to transmit the ink energization data, laminate energization data and correction data to the printer to cause the printer to correct the laminate energization data using the correction data and issue a thermal transfer instruction of the ink and laminate material in accordance with the ink energization data and the laminate energization data after correction to the printer. The printer includes a first storage section configured to store the ink energization data received from the computer, a second storage section configured to store the laminate energization data received from the computer, a third storage section configured to store the correction data received from the computer, an energization controlling section configured to energize the thermal head in accordance with the energization data, and a correction section configured to correct the laminate energization data from the second storage section to the energization controlling section using the correction data stored in the third storage section.

With the printing system having the configuration described above, the laminate material can be thermally transferred with the laminate energization data corrected with the residual heat quantity of the thermal head after thermal transfer of the ink taken into consideration, and the print quality can be improved. Besides, with the printer, it is possible to achieve thermal transfer with the residual heat quantity of the thermal head taken into consideration only by correcting the laminate energization data by such simple arithmetic operation as synthesis of the laminate energization data and the correction data like addition, subtraction, multiplication or division and energizing the thermal head in accordance with the corrected data. Consequently, the necessity to incorporate a high speed arithmetic operation unit such as a DSP (Digital Signal Processor) into the printer is eliminated, and the cost of the printer can be reduced.

It is possible to specify steps executed by the computer in the printing system from a point of view of a program. In particular, according to a further embodiment of the present invention, there is provided a computer program for causing a computer, which is connected for communication with a printer wherein a ribbon is heated by energization of a thermal head to thermally transfer color ink and transparent laminate material from the ribbon to a recording medium, to issue a thermal transfer instruction based on accepted image data to the printer. The program includes producing ink energization data for thermally transferring the ink based on accepted image data, producing or acquiring laminate energization data for thermally transferring the laminate material, estimating a residual heat quantity of the thermal head after the ink is thermally transferred in accordance with the image data or the ink energization data and producing correction data for correcting the laminate energization data in accordance with the estimated residual heat quantity, and transmitting the ink energization data, laminate energization data and correction data obtained at the above steps to the printer to instruct the printer to correct the laminate energization data using the correction data and carry out thermal transfer of the ink and laminate material in accordance with the ink energization data and the corrected laminate energization data.

With the program, only if the printer carries out energization based on the ink energization data received from the computer, thermal transfer of the ink is carried out, and only if the printer carries out correction of the laminate energization data received from the computer with the correction data and carries out energization based on the corrected laminate energization data, thermal transfer with the residual heat quantity of the thermal head taken into consideration can be carried out. Consequently, the necessity to incorporate a high speed arithmetic operation unit such as a DSP (Digital Signal Processor) into the printer is eliminated, and the cost of the printer can be reduced.

With the printer, printing system and computer program, the correction section corrects laminate energization data using correction data for correcting laminate energization data in response to a residual heat quantity. Therefore, the laminate material can be thermally transferred with the laminate energization data corrected with the residual heat quantity of the thermal head after the ink is thermally transferred taken into consideration. Consequently, the print quality can be improved.

The above and other objects, features and advantages of the present invention will become apparent from the following description and the appended claims, taken in conjunction with the accompanying drawings in which like parts or elements denoted by like reference characters.

DETAILED DESCRIPTION OF THE PREFERRED EMBODIMENTS

In the following, a printing system to which the present invention is applied is described with reference to the accompanying drawings.

Figure 1:
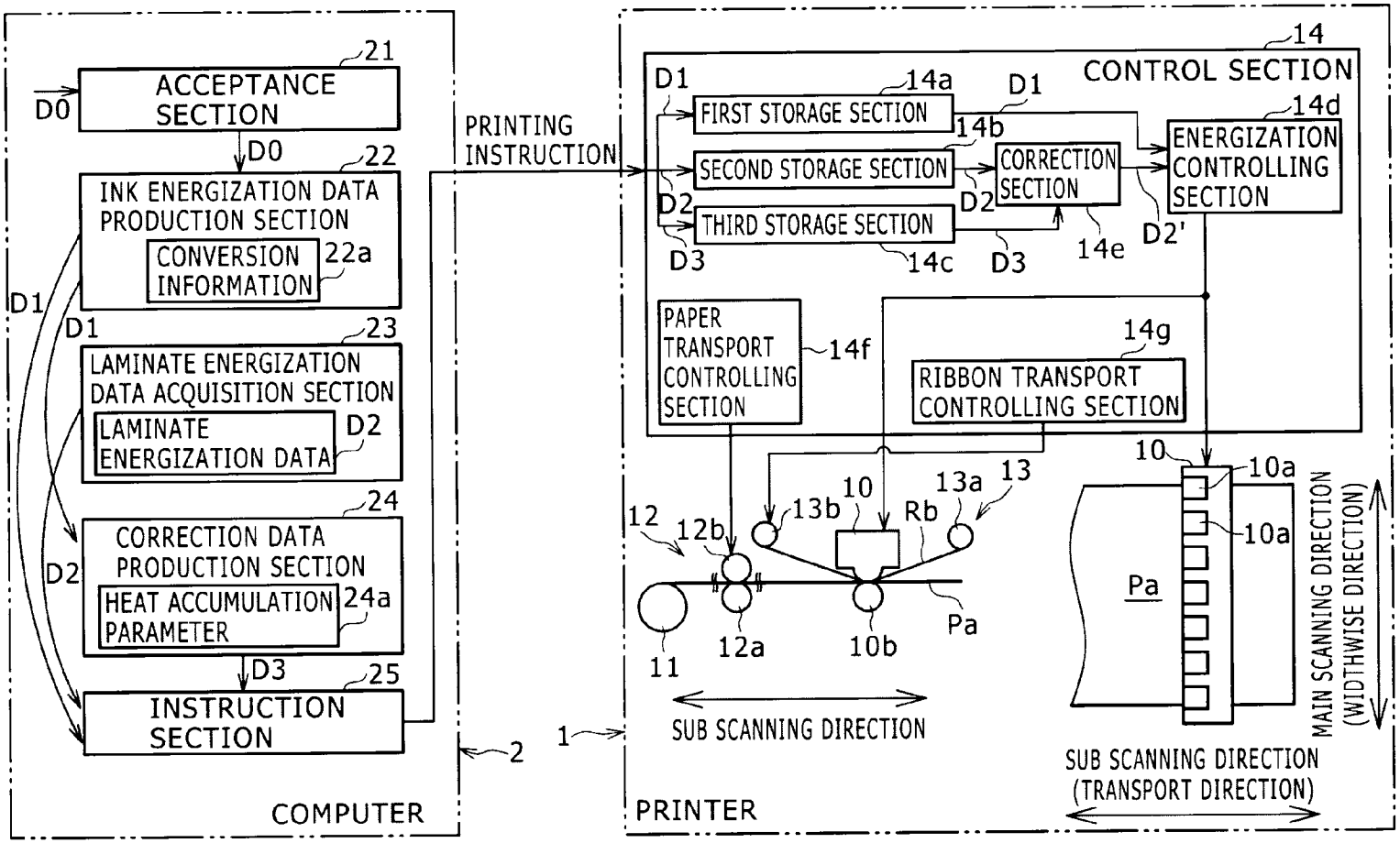
FIG. 1 is a block diagram schematically showing a printing system to which the present invention is applied.
Figure 2:
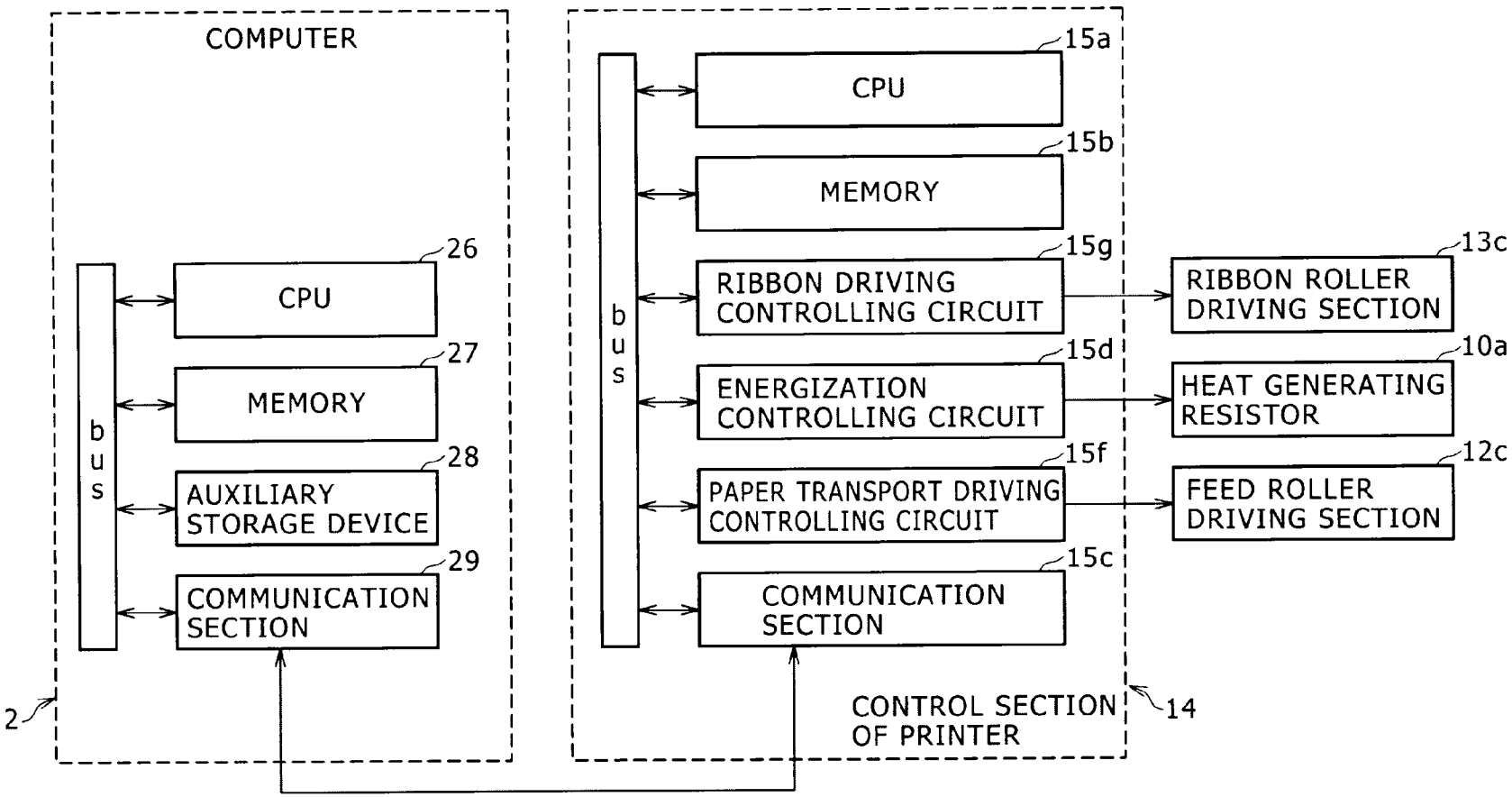
FIG. 2 is a block diagram schematically showing a hardware configuration of a printer and a computer which configure the printing system.

Referring first to FIGS. 1 and 2, the printing system shown includes a printer 1, and a computer 2 configured for communication with the printer 1 for instructing the printer 1 to carry out thermal transfer.

Referring particularly to FIG. 1, the printer 1 includes a thermal head 10 on which a plurality of heat generating resistive elements 10*a* which generate heat when they are energized are disposed such that they configure one line, and a paper supplying section 11 which holds a recording medium Pa such as a paper roll so as to be supplied. The printer 1 further includes a paper transport section 12 for transporting the recording medium Pa, a ribbon transport section 13 for supplying a ribbon Rb to the thermal head 10, and a control section 14 for controlling driving of the functional blocks 10 to 13. Thus, in the printer 1, the ribbon Rb is heated by energization of the thermal head 10 to thermally transfer color ink and transparent laminate material applied to the ribbon Rb from the ribbon Rb to the recording medium Pa. It is to be noted that the arrayed direction of the heat generating resistive elements 10*a* is hereinafter referred to as main scanning direction, and the transport direction orthogonal to the main scanning direction is hereinafter referred to as sub scanning direction.

Figure 5:
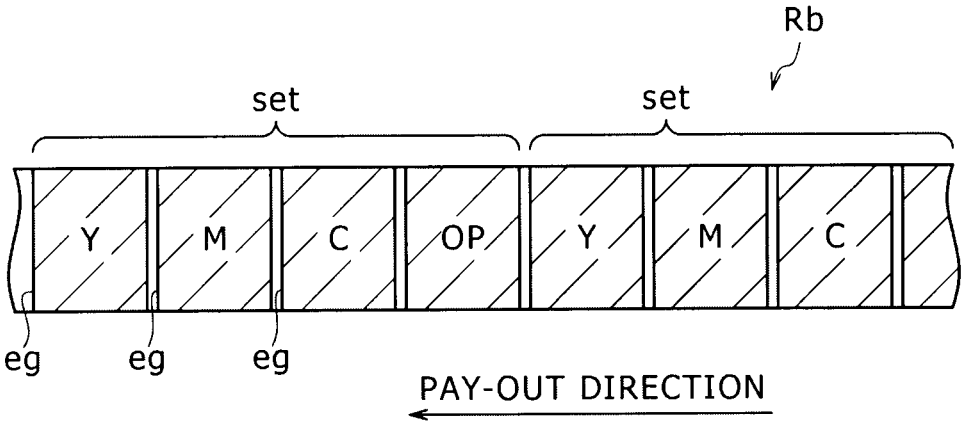
FIG. 5 is an exemplary ribbon for use in the printer of the present disclosure, having color ink sections and transparent laminate section thereon.

FIG. 5 shows an example of the ribbon Rb. The ribbon Rb includes a plurality of sets of yellow ink section Y, magenta ink section M and cyan ink section C, followed by a transparent laminate material section OP in this order.

As seen in FIG. 1, a region for one screen image which is a printing target of the recording medium Pa is represented by a plurality of pixels or dots arrayed in a matrix along the main scanning direction and the sub scanning direction, and where those pixels which are arrayed in a row along the main scanning direction configure one line, the region is represented by a plurality of lines.

The heat generating resistive elements 10*a* are devices which generate heat whey then are energized and are provided individually for the pixels or dots arrayed in a row along the main scanning direction. Each heat generating resistive element 10*a* thermally transfers, by heat generation by energization thereof, ink and laminate material applied to the ribbon Rb to the recording medium Pa to print a corresponding pixel. The printer 1 energizes a plurality of heat generating resistive elements 10*a* to print dots in a unit of a line while transporting the recording medium Pa and the ribbon Rb in the sub scanning direction, and successively prints line by line along a printing direction which is one of the sub scanning directions. A platen roller 10*b* is provided at a position opposing to the thermal head 10, and the thermal head 10 and the platen roller 10*b* are configured for relative movement into and out of contact with each other. When printing is to be carried out, the ribbon Rb and the recording medium Pa are pressed against each other by the thermal head 10 and the platen roller 10*b*.

The paper transport section 12 is configured from a feed roller 12*a* and a pinch roller 12*b* as principal components thereof. The feed roller 12*a* is driven to rotate by a feed roller driving section 12*c* (refer to FIG. 2) configured using a motor or the like in a state in which the recording medium Pa is held by and between the rollers 12*a* and 12*b* to transport the recording medium Pa.

The ribbon transport section 13 transports the ribbon Rb between a supply side ribbon roller 13*a* and a take-up side ribbon roller 13*b*. As a particular example, the take-up side ribbon roller 13*b* is driven to rotate by a ribbon roller driving section 13*c* (refer to FIG. 2) configured using a motor or the like to deliver the ribbon Rb from the supply side ribbon roller 13*a* to the thermal head 10 while the ribbon Rb from the thermal head 10 is taken up on the take-up side ribbon roller 13*b*.

The control section 14 includes a first storage section 14*a*, a second storage section 14*b*, a third storage section 14*c*, a correction section 14*e*, an energization controlling section 14*d*, a paper transport controlling section 14*f*, and a ribbon transport controlling section 14*g*. The control section 14 controls energization of the heat generating resistive element 10*a* and driving of the ribbon transport section 13 and the paper transport section 12 in accordance with a printing instruction received from the outside, particularly from the computer 2, to implement a series of operations necessary for printing. Referring to FIG. 2, the control section 14 is configured from an ordinary microcomputer unit including a CPU 15*a*, a memory 15*b* and a communication section 15*c* connected to each other by a bus similarly as in the known printer. The memory 15*b* has required programs such as a printing control process routine not shown written therein, and the CPU 15*a* suitably calls and executes a necessary program and cooperates with associated hardware resources to implement the sections 14*d*, 14*e*, 14*f* and 14*g*.

Referring to FIGS. 1 and 2, the paper transport controlling section 14*f* for controlling the transportation of the recording medium Pa is implemented by a paper transport driving controlling circuit 15*f* which controls driving the feed roller driving section 12*c*. The ribbon transport controlling section 14*g* which controls the transportation of the ribbon Rb is implemented by a ribbon driving controlling circuit 15*g* which controls driving of the ribbon roller driving section 13*c*.

The first storage section 14*a* is implemented utilizing part of a storage area of the memory 15*b* shown in FIG. 2 and temporarily stores ink energization data D1 included in a printing instruction received from the outside, that is, from the computer 2, as seen in FIG. 1. The data D1 is data for thermally transferring ink applied to the ribbon Rb, and particularly is pulse data indicative of a number of pulses to be used for the energization of a heat generating resistive element 10*a* per unit time for each pixel in order to transfer a desired amount of ink to obtain a desired print gradation. Such ink energization data D1 are stored for each of kinds of inks such as yellow, magenta and cyan inks.

The second storage section 14*b* is implemented utilizing part of a storage area of the memory 15*b* shown in FIG. 1 and temporarily stores laminate energization data D2 included in the printing instruction received from the outside, that is, from the computer 2. The laminate energization data D2 is data for thermally transferring laminate material applied to the ribbon Rb and particularly is pulse data indicative of a number of pulses to be used for energization of each heat generating resistive element 10*a* per unit time for each pixel in order to transfer a desired amount of laminate material thereby to obtain a desired print gradation.

The energization controlling section 14*d* is implemented by an energization controlling circuit 15*d* shown in FIG. 2 and energizes each heat generating resistive element 10*a* with a number of pulses corresponding to the ink energization data D1 and the laminate energization data D2 described hereinabove to control heat generation of the heat generating resistive element 10*a*.

The third storage section 14*c* is implemented utilizing part of a storage area of the memory 15*b* shown in FIG. 2 and temporarily stores correction data D3 included in a printing instruction received from the outside, that is, from the computer 2, as seen in FIG. 1. The correction data D3 is data for correcting the laminate energization data D2 in response to a residual heat quality of the thermal head 10 after ink is thermally transferred by energization based on the ink energization data D1 stored in the first storage section 14*a*. Details of the correction data D3 are hereinafter described.

The correction section 14*e* acquires the correction data D3 from the third storage section 14*c* and uses the acquired correction data D3 to correct the laminate energization data D2 from the second storage section 14*b* to the energization controlling section 14*d*. In particular, the correction section 14*e* synthesizes the correction data D3 and the laminate energization data D2 by addition-subtraction or the like to correct the laminate energization data D2 and inputs resulting laminate energization data D2' to the energization controlling section 14*d*.

The computer 2 which instructs the printer 1 having the configuration described to carry out thermal transfer is configured using a popular personal computer including a CPU 26, a memory 27, an auxiliary storage device 28 and a communication section 29 connected to each other by a bus as seen in FIG. 2. The CPU 26 executes a printer driver process program illustrated in FIG. 3 also called device driver installed in advance in the auxiliary storage device 28 such as a hard disk and cooperates with peripheral hardware resources to implement an acceptance section 21, an ink energization data production section 22, a laminate energization data acquisition section 23, a correction data production section 24 and an instruction section 25 shown in FIG. 1. It is to be noted that required programs such as a basic program (OS: Operating System) are stored in the auxiliary storage device 28 in addition to the computer program to which the present invention is applied. The computer 2 and the printer 1 are connected for communication to each other by wire communication or wireless communication through the respective communication sections 15*c* and 29 as seen in FIG. 2. While, in the present embodiment, a personal computer is adopted as the computer, alternatively a controller for exclusive use may otherwise be incorporated.

Referring back to FIG. 1, the acceptance section 21 plays a roll of an interface for accepting image data D0 of a printing object from different software or an external apparatus. In the present embodiment, the image data D0 is data representative of a print gradation for each pixel. Although this data is provided for individual types of ink such as yellow, magenta and cyan inks, it may otherwise be data of a different form.

The ink energization data production section 22 produces ink energization data D1 described hereinabove based on image data D0 accepted by the acceptance section 21. The ink energization data production section 22 has conversion information 22*a* for converting image data D0 into energization data or pulse data and produces ink energization data D1 using the conversion information 22*a*.

The laminate energization data acquisition section 23 acquires laminate energization data D2 set in advance. The laminate energization data D2 are data of random arrangement of two print gradations at the pixels and are also called matt print data. The first print gradation and the second print gradation are set to numbers of pulses by which the laminate material is to be thermally transferred and besides are set such that the heat quantity is greater with the first print gradation than with the second print gradation. Thus, the first print gradation and the second print gradation are set such that, if thermal transfer is carried out with the first print gradation, then gloss is provided on a print result, but a print result with the second print gradation provides a matted state wherein no gloss is exhibited. Naturally, the laminate energization data set in advance may be data of arrangement of two print gradations as a predetermined pattern. Or, all pixels may be set to one print gradation, or in other words, full gloss print or full matt print may be implemented. Further, the number of print gradations to be used is not limited to two but may be equal to or greater than two. Naturally, the laminate energization data acquisition section 23 may be configured otherwise such that it produces laminate energization data in response to image data or some other external instruction.

The correction data production section 24 estimates a residual heat quantity of the thermal head 10, particularly the heat generating resistive elements 10*a*, after ink is thermally transferred based on the image data D0 accepted by the acceptance section 21 or the ink energization data D1 produced by the ink energization data production section 22, and produces correction data D3 for correcting the laminate energization data D2 in response to the estimated residual heat quantity. More particularly, a technique of calculating the accumulated heat quality disclosed also in Japanese Patent Laid-Open No. Hei 11-198425 is used, and a residual heat quantity is calculated or estimated based on a heat accumulation parameter 24*a* set in advance and the number of pulses indicated by the ink energization data D1, and the correction data D3 is produced such that the corrected laminate energization data D2' may have a value determined with the residual heat quantity taken into consideration. A more particular example is described. In particular, where the number of pulses for obtaining a certain print gradation at a certain pixel in the laminate energization data D2 is F1, if unnecessary residual heat exhibits an effect that a number of pulses equal to F1+F2 are applied, then the correction data D3 is data for correcting the pulse number represented by the laminate energization data D2 in a decreasing direction in which it is decreased from F1 to F1−F2. In this example, the correction value indicated by the correction data D3 is −F2. The arithmetic operation to reduce the laminate energization data D2 may be any of addition, subtraction, multiplication and division. Further, since the residual heat arising from thermal transfer of ink is gradually radiated and the influence of the residual heat gradually decreases, the correction data D3 is produced such that the value thereof decreases as printing proceeds, along the printing direction. Further, although the ink energization data D1 includes data for the individual types of inks such as yellow, magenta and cyan ink, and since the influence of the cyan ink which is thermally transferred immediately preceding to the laminate material is dominant, the residual heat quantity estimated based on the cyan ink energization data is used preferentially to those of the other inks.

The instruction section 25 transmits the ink energization data D1, laminate energization data D2 and correction data D3 to the printer 1 so that the printer 1 corrects the laminate energization data D2 using the correction data D3 and instructs the printer 1 to carry out thermal transfer of the ink and the laminate material based on the ink energization data D1 and the corrected laminate energization data D2'. Thereupon, the transmission of the data D1, D2 and D3 to the printer 1 and the instruction to the printer 1 are executed through the communication sections 15*c* and 29 (refer to FIG. 2).

Figure 3:
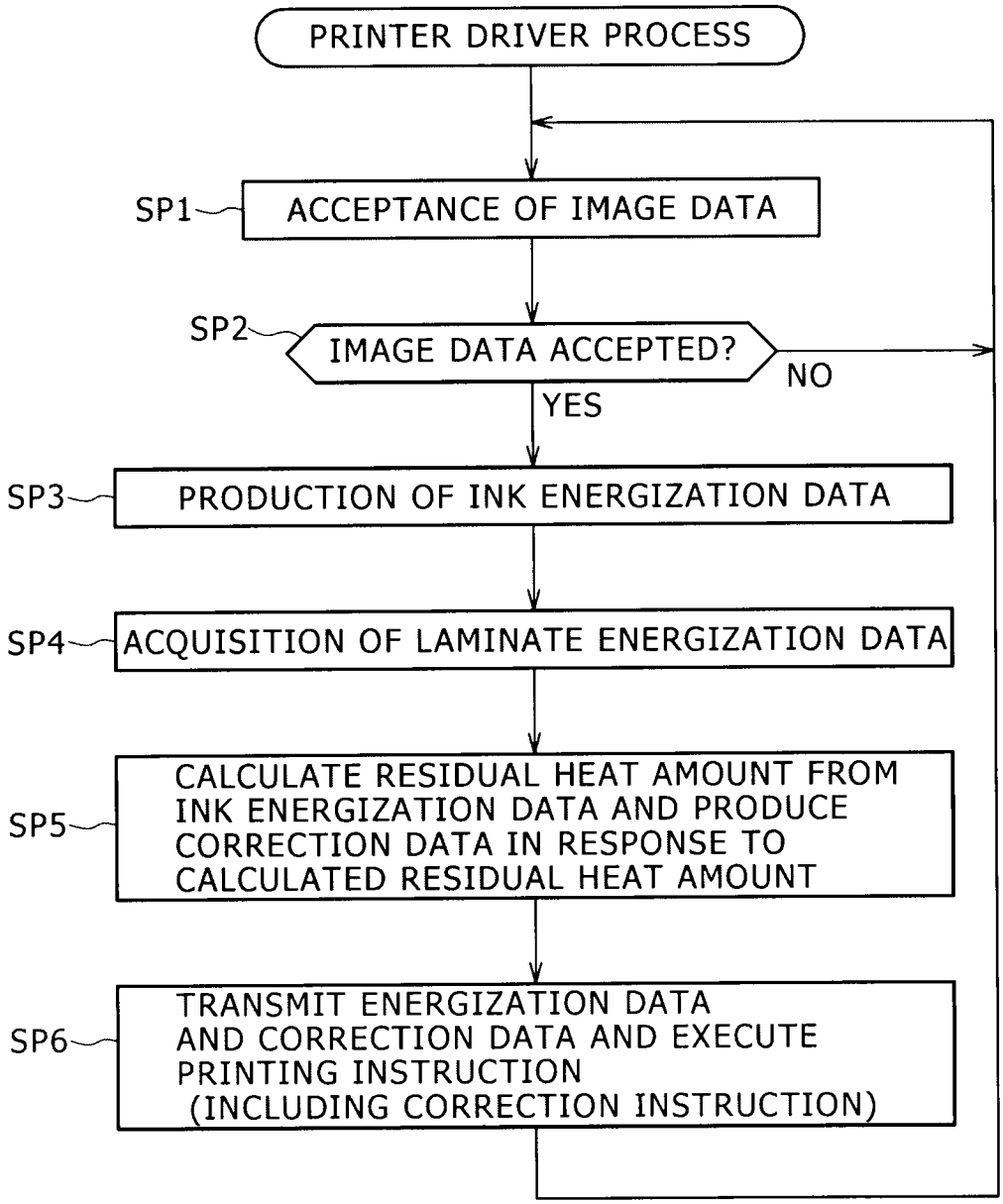
FIG. 3 is a flow chart illustrating a printer driver process routine executed by the printer.

The printing system having the configuration described above operates in the following manner. Referring to FIGS. 1 and 3, the computer 2 executes a step SP1 of accepting image data D0 of a printing object from different software and decides, at next step SP2, whether or not image data D0 is accepted. If it is decided at step SP2 that image data D0 is accepted (SP2: YES), then the computer 2 produces ink energization data D1 based on the image data D0 at step SP3 and acquires laminate energization data D2 at step SP4, whereafter it produces correction data D3 based on the image data D0 or the ink energization data D1 at step SP5. Then at step SP6, the computer 2 transmits the energization data D1 and D2 and the correction data D3 to the printer 1 and instructs the printer 1 to correct the laminate energization data D2 using the correction data D3 and carry out thermal transfer of the inks and the laminate material in accordance with the ink energization data D1 and the corrected laminate energization data D2'. Thereafter, the processing of the printer 1 returns to step SP1.

The printer 1 receives the energization data D1 and D2 and the correction data D3 from the computer 2 and stores the ink energization data D1 into the first storage section 14*a*, stores the laminate energization data D2 into the second storage section 14*b* and stores the correction data D3 into the third storage section 14*c*. When the ink is to be thermally transferred, energization in accordance with the ink energization data D1 read out from the first storage section 14*a* is carried out. When the laminate material is to be thermally transferred, the laminate energization data D2 read out from the second storage section 14*b* and the correction data D3 stored in the third storage section 14*c* are synthesized by the correction section 14*e* to obtain corrected laminate energization data D2'. Then, energization in accordance with the corrected laminate energization data D2' is carried out.

As described above, the printer according to the present embodiment is a printer wherein a ribbon Rb is heated by energization of a thermal head 10 to transfer color ink and transparent laminate material from the ribbon Rb to a recording medium Pa, including a first storage section 14*a* configured to store ink energization data D1 for thermally transferring the ink, a second storage section 14*b* configured to store laminate energization data D2 for thermally transferring the laminate material, an energization controlling section 14*d* configured to energize the thermal head 10 in accordance with the energization data D1 and D2, and a correction section 14*e* configured to acquire correction data D3 for correcting the laminate energization data D2 in response to a residual heat quantity of the thermal head 10 after the ink is thermally transferred in accordance with the ink energization data D1 stored in the first storage section 14*a* and correct the laminate energization data D2 from the second storage section 14*b* to the energization controlling section 14*d* using the correction data D3.

With the printer having the configuration described, the ink energization data D1 for thermally transferring the ink and the laminate energization data D2 for thermally transferring the laminate material are stored in the first and second storage sections 14*a* and 14*b*, respectively, and the energization controlling section 14*d* carries out energization of the thermal head 10 in accordance with the energization data D1 and D2 so that the inks and the laminate material are thermally transferred to the recording medium Pa. In this instance, although the thermal transfer of the laminate material is influenced by the residual heat quantity of the thermal head 10 after the ink is thermally transferred, since the correction section 14*e* acquires the correction data D3 for correcting the laminate energization data D2 in response to the residual heat quantity and corrects the laminate energization data D2 using the correction data D3, the laminate material can be thermally transferred with the laminate energization data D2' corrected with the residual heat quantity of the thermal head 10 after the thermal transfer of ink taken into consideration. Consequently, the print quality can be improved.

Particularly, in the present embodiment, the printer is configured such that it further includes a third storage section 14*c* configured to store the correction data D3 and the correction section 14*e* acquires the correction data D3 from the third storage section 14*c* and synthesizes the acquired correction data D3 and the laminate energization data D2 to correct the laminate energization data D2. Therefore, it is possible to achieve thermal transfer with the residual heat quantity of the thermal head 10 taken into consideration by correcting the laminate energization data D2 by such simple arithmetic operation as synthesis of the laminate energization data D2 and the correction data D3 like addition, subtraction, multiplication or division and energizing the thermal head 10 in accordance with the corrected data. Consequently, the necessity to incorporate a high speed arithmetic operation unit such as a DSP (Digital Signal Processor) into the printer is eliminated, and the cost of the printer can be reduced.

The printing system according to the present embodiment is a printing system including a printer 1 wherein a ribbon Rb is heated by energization of a thermal head 10 to thermally transfer color ink and transparent laminate material from the ribbon Rb to a recording medium Pa, and a computer 2 configured for communication with the printer 1 for issuing a thermal transfer instruction to the printer 1, the computer 2 including an acceptance section 21 for accepting image data D0 to be used as a printing object, an ink energization data production section 22 for producing ink energization data D1 for thermally transferring ink in accordance with the image data D0 accepted by the acceptance section 21, a laminate energization data acquisition section 23 for producing or acquiring laminate energization data D2 for thermally transferring the laminate material, a correction data production section 24 for estimating a residual heat quantity of the thermal head 10 after ink is transferred in accordance with the image data D0 or the produced ink energization data D1 and producing the correction data D3 for correcting the laminate energization data D2 in accordance with the estimated residual heat quantity, and an instruction section 25 for transmitting the ink energization data D1, laminate energization data D2 and correction data D3 to the printer 1 to cause the printer 1 to correct the laminate energization data D2 using the correction data D3 and issuing a thermal transfer instruction of the ink and laminate material in accordance with the ink energization data D1 and the corrected laminate energization data D2' to the printer 1, the printer 1 including a first storage section 14*a* for storing the ink energization data D1 received from the computer 2, a second storage section 14*b* for storing the laminate energization data D2 received from the computer 2, a third storage section 14*c* for storing the correction data D3 received from the computer 2, an energization controlling section 14*d* for energizing the thermal head 10 in accordance with the energization data D1 and D2, and a correction section 14*e* for correcting the laminate energization data D2 from the second storage section 14*b* to the energization controlling section 14*d* using the correction data D3 stored in the third storage section 14*c*.

With the printing system having the configuration described above, the laminate material can be thermally transferred with the corrected laminate energization data D2' with the residual heat quantity of the thermal head 10 after thermal transfer of the ink taken into consideration, and the print quality can be improved. Besides, with the printer 1, it is possible to achieve thermal transfer with the residual heat quantity of the thermal head 10 taken into consideration only by correcting the laminate energization data D2 by such simple arithmetic operation as synthesis of the laminate energization data D2 and the correction data D3 like addition, subtraction, multiplication or division and energizing the thermal head 10 in accordance with the corrected data. Consequently, the necessity to incorporate a high speed arithmetic operation unit such as a DSP (Digital Signal Processor) into the printer is eliminated, and the cost of the printer can be reduced.

The computer program according to the present embodiment is a computer program for causing a computer 2, which is connected for communication with a printer 1 wherein a ribbon Rb is heated by energization of a thermal head 10 to thermally transfer color ink and transparent laminate material from the ribbon Rb to a recording medium Pa, to issue a thermal transfer instruction based on accepted image data D0 to the printer 1, including producing ink energization data D1 for thermally transferring the ink based on accepted image data D0, producing or acquiring laminate energization data D2 for thermally transferring the laminate material, estimating a residual heat quantity of the thermal head 10 after the ink is thermally transferred in accordance with the image data D0 or the ink energization data D1 and producing correction data D3 for correcting the laminate energization data D2 in accordance with the estimated residual heat quantity, and transmitting the ink energization data D1, laminate energization data D2 and correction data D3 obtained at the above steps to the printer 1 to instruct the printer 1 to correct the laminate energization data D2 using the correction data D3 and carry out thermal transfer of the ink and laminate material in accordance with the ink energization data D1 and the corrected laminate energization data D2'.

With the program, only if the printer 1 carries out energization based on the ink energization data D1 received from the computer 2, thermal transfer of the ink is carried out, and only if the printer 1 carries out correction of the laminate energization data D2 received from the computer 2 with the correction data D3 and carries out energization based on the corrected laminate energization data D2', thermal transfer with the residual heat quantity of the thermal head 10 taken into consideration can be carried out. Consequently, the necessity to incorporate a high speed arithmetic operation unit such as a DSP (Digital Signal Processor) into the printer is eliminated, and the cost of the printer can be reduced.

Although the printers, printing system and computer program to which the present invention is applied are described above, they can be modified in various manners. The scope of the invention is indicated not only by the foregoing description of the embodiment but also by the appended claims. All changes which come within the meaning and range of equivalency of the claims are to be embraced within their scope.

Figure 4:
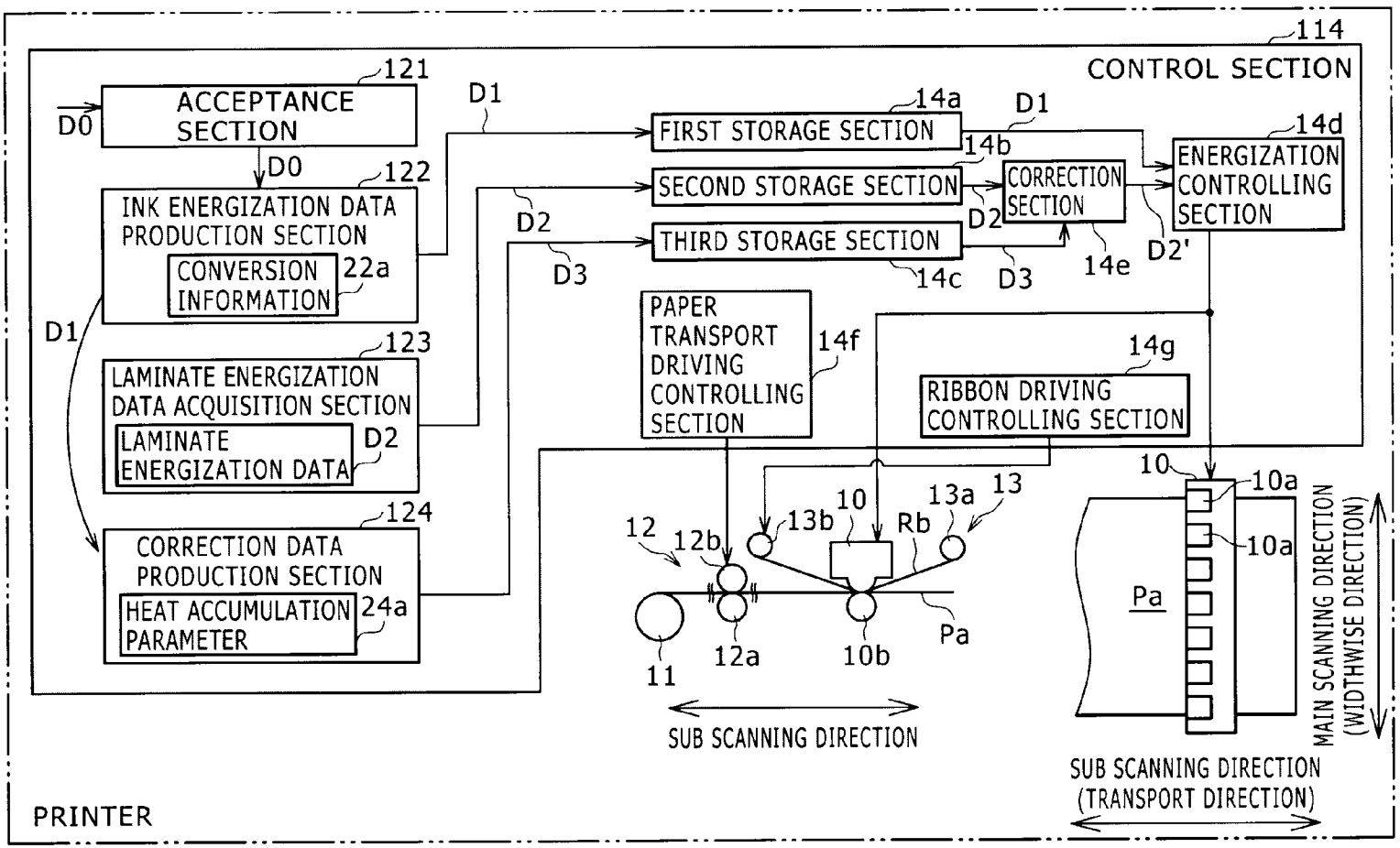
FIG. 4 is a block diagram schematically showing another printer to which the present invention is applied.

For example, in the present embodiment, the ink energization data production section 22 for producing ink energization data D1 from image data D0 and so forth are implemented by the computer 2 other than the printer to eliminate the necessity to incorporate a high speed arithmetic operation unit such as a DSP (Digital signal Processor) into the printer thereby to reduce the fabrication cost of the printer. However, the printer may otherwise be configured in such a manner as shown in FIG. 4. Referring to FIG. 4, the printer 101 shown includes a control section 114 which in turn includes an acceptance section 121 for accepting image data D0 of a printing object, an ink energization data production section 122 for producing ink energization data D1 based on the image data D0 accepted by the acceptance section 121 and storing the ink energization data D1 into a first storage section 14*a*, a laminate energization data acquisition section 123 for producing or acquiring laminate energization data D2 and storing the laminate energization data D2 into a second storage section 14*b*, and a correction data production section 124 for estimating the residual heat quantity of the thermal head 10 after the ink is thermally transferred based on the image data D0 or the produced ink energization data D1 and producing correction data D3 for correcting the laminate energization data D2 in response to the estimated residual heat quantity.

Further, while, in the embodiment described hereinabove, the functional blocks 14*a*, 14*b*, 14*c* and 14*e* shown in FIG. 1 are implemented by the CPU 15*a* executing a predetermined program, the functional blocks may otherwise be configured from a memory for exclusive use or a circuit for exclusive use.

While preferred embodiments of the present invention have been described using specific terms, such description is for illustrative purpose only, and it is to be understood that changes and variations may be made without departing from the spirit or scope of the following claims.

It should be understood by those skilled in the art that various modifications, combinations, sub-combinations and alterations may occur depending on design requirements and other factor in so far as they are within the scope of the appended claims or the equivalents thereof.

What is claimed is:

1. A printer comprising:

a thermal head configured to heat a ribbon and to thermally transfer color ink and transparent laminate material from the ribbon onto a recording medium;

a first storage section configured to store first energization data for thermally transferring the color ink onto the recording medium;

a second storage section configured to store second energization data for thermally transferring the laminate material onto the recording medium;

an energization controlling section configured to energize the thermal head to thermally transfer the color ink onto the recording medium in accordance with the first energization data; and a correction section configured to acquire correction data for correcting the second energization data in accordance with a residual heat of the thermal head, which remains after the color ink is thermally transferred in accordance with the first energization data, to correct the second energization data stored in the second storage section with the correction data, and to produce corrected energization data, wherein the energization controlling section energizes the thermal head to thermally transfer the transparent laminate material onto the recording medium in accordance with the corrected energization data.

2. The printer according to claim 1, further comprising:

a third storage section configured to store the correction data, wherein the correction section acquires the correction data from the third storage section and synthesizes the correction data and the second energization data to produce the corrected energization data.

3. The printer according to claim 1, further comprising:

a receiving section configured to receive image data to be used as a printing object;

a first energization data production section configured to produce the first energization data based on the image data received by the receiving section and to store the first energization data in the first storage section;

a second energization data production section configured to produce the second energization data and to store the second energization data in the second storage section; and a correction data production section configured to estimate the residual heat of the thermal head, and to produce the correction data for correcting the second energization data in accordance with the estimated residual heat.

4. The printer according to claim 1, wherein the ribbon includes a plurality of ordered sets of at least three color ink sections and a transparent laminate material section, the first energization data including at least three energization data components each corresponding to the at least three color ink sections.

5. The printer according to claim 4, wherein the at least three color ink sections include a yellow ink section, a magenta ink and a cyan ink section, the correction data being based on one of the at least three energization data components which corresponds to the cyan ink sections.

6. The printer according to claim 1, wherein the corrected energization data produced by the correction section and applied is smaller than the second energization data as determined by the correction data.

7. The printer according to claim 6, wherein the correction data becomes smaller to make a difference between the second energization data and the corrected energization data smaller, as the thermal transferring of the transparent laminate material onto the recording medium progresses.

8. A printing system, comprising:

a printer having a thermal head configured to thermally transfer color ink and transparent laminate material from a ribbon onto a recording medium; and a computer, configured to communicate with the printer and to issue a thermal transfer instruction to the printer, wherein the computer includes a receiving section configured to receive image data to be used as a printing object, a first energization data production section configured to produce first energization data for thermally transferring the color ink in accordance with the image data received by the receiving section, a second energization data production section configured to produce second energization data for thermally transferring the transparent laminate material, a correction data production section configured to estimate a residual heat of the thermal head, which remains after the color ink is transferred in accordance with the image data or the first energization data, and to produce correction data for correcting the second energization data in accordance with the estimated residual heat, and an instruction section configured to transmit to the printer the thermal transfer instruction including the first energization data, the second energization data and the correction data, and wherein the printer includes a first storage section configured to store the first energization data received from the computer, a second storage section configured to store the second energization data received from the computer, a third storage section configured to store the correction data received from the computer, an energization controlling section configured to energize the thermal head to thermally transfer the color ink onto the recording medium in accordance with the first energization data, and a correction section configured to correct the second energization data with the correction data and to send corrected energization data to the energization controlling section, the energization controlling section energizing the thermal head to thermally transfer the transparent laminate material onto the recording medium in accordance with the corrected energization data.

9. A non-transitory computer-readable medium having instructions recorded thereon that perform a method when executed by a computer, which communicates with a printer having a thermal head configured to thermally transfer color ink and transparent laminate material from a ribbon onto a recording medium, the method comprising:

producing first energization data for thermally transferring the color ink in accordance with image data;

producing second energization data for thermally transferring the transparent laminate material;

estimating a residual heat of the thermal head, which remains after the color ink is thermally transferred in accordance with the image data or the first energization data and producing correction data for correcting the second energization data in accordance with the estimated residual heat; and transmitting the first energization data, the second energization data and the correction data to the printer.

* * * * *